United States Patent [19]

Naab

[11] Patent Number: 4,551,057

[45] Date of Patent: Nov. 5, 1985

[54] DEVICE FOR EMPTYING CONTAINERS INTO A COLLECTOR

[75] Inventor: Jakob Naab, Mainz-Laubenheim, Fed. Rep. of Germany

[73] Assignee: Zoller-Kipper GmbH, Mainz-Laubenheim, Fed. Rep. of Germany

[21] Appl. No.: 475,843

[22] Filed: Mar. 16, 1983

[30] Foreign Application Priority Data

Mar. 16, 1982 [DE] Fed. Rep. of Germany ... 8207261[U]
Mar. 16, 1982 [DE] Fed. Rep. of Germany ... 8207262[U]

[51] Int. Cl.[4] ..... B65F 3/04
[52] U.S. Cl. ..... 414/420; 414/719
[58] Field of Search ..... 414/406, 408, 409, 420, 414/731, 662–665, 668–670, 719; 294/88, 99 R, DIG. 2; 403/220, 223, 224

[56] References Cited

U.S. PATENT DOCUMENTS 3,410,431 11/1968 Vik ..... 294/88
3,508,674 4/1970 Schneider ..... 414/719

FOREIGN PATENT DOCUMENTS 1201756 9/1965 Fed. Rep. of Germany ..... 414/408
2553548 2/1977 Fed. Rep. of Germany ..... 414/408
2920900 12/1980 Fed. Rep. of Germany ..... 414/408

*Primary Examiner*—Robert G. Sheridan
*Attorney, Agent, or Firm*—Karl F. Ross; Herbert Dubno

[57] ABSTRACT

A device for emptying containers into a collector, in particular for emptying dustbins into dust-carts, in which a plate-shaped or bow-shaped contact element for the container to be emptied is attached in the lower region of the swivel arm of a tipping device or the lifting and tipping frame of a lift and tip device and is equipped with safety devices protecting it against the effect of impacts.

26 Claims, 11 Drawing Figures

DEVICE FOR EMPTYING CONTAINERS INTO A COLLECTOR

BACKGROUND OF THE INVENTION

DE-PS No. 1 024 009 discloses a tipping device for dustbins, in which a contact plate for the dustbins to be emptied is mounted at the free end of a swivel arm to rock about a shaft parallel to the swivel axis. In order to maintain the contact plate in its operating position substantially parallel to the longitudinal axis of the swivel arm, it is also held to the swivel arm in its upper part by means of a shearing bolt. This shearing bolt and the rocking shaft of the contact plate together constitute a safety device protecting against the effect of impact. This safety device, however, is only effective against those impacts which are liable to cause the contact plate to rock relatively to the swivel arm but remains ineffective against any other impact on the contact plate. This safety device is only intended to prevent damage to the dustbin emptying device attached to the back of the dust-cart if in the event of rearward collision of the cart the contact plate situated in its lower starting position strikes against an obstacle on the ground. Lateral impact on the contact plate, on the other hand, is liable to cause severe damage to the plate or the swivel arm or any other part of the emptying device. In particular, the contact plate of this known arrangement is quite incapable of yielding resiliently or absorbing any shock on impact.

DE-PS No. 1 048 221 discloses a dustbin tipper, in particular a lifting and tipping device, in which a contact plate for the dustbin is connected by rocking elements to the swivel arm or to the lifting and tipping frame and is equipped with a vibrating shaker device. Although the rocking elements enable the contact plate to vibrate, they provide no protection against the effect of impact, nor do they provide any significant elastic buffering of the contact plate against the swivel arm or lifting and tipping frame.

Lastly, DE-PS No. 1 119 758 discloses a swivel arm for tipping dustbins of various sizes, in which a tipping stool is mounted on a front plate which closes the feed opening of the emptying device. The swivel axis of this tipping stool extends parallel to the swivel axis of the swivel arm proper. The rocking movement of the swivel arm is transmitted to the tipping stool by means of a transmission link which is pivotally attached between these two parts and is so designed that it also serves as a resilient shock absorbing device. This shock absorbing device, however, provides no protection against impact acting on the contact plate of the tipping stool.

OBJECT OF THE INVENTION

It is thus an object of the present invention substantially to improve a container emptying device having a plate-shaped or bow-shaped contact element in the lower region of the swivel arm of a tipping device or of the lifting and tipping frame of a lift and tip device so that, firstly, the contact element will be effectively protected against the shock of impacts acting from any direction and, secondly, the contact element will be more yielding so that it can right itself in relation to the container to be emptied even if the container has been placed crookedly or in some other manner incorrectly against the emptying device, especially in order to avoid damaging impacts being exerted on the wall of the container by the contact element.

SUMMARY OF THE INVENTION

To solve this problem according to the invention, the contact element is designed to be capable of limited spatial displacement relative to the swivel arm or lifting and tipping frame in order to enable it to adapt to an object exerting pressure on it, this displaceability being provided by means of at least one yielding buffering and damping device provided at least in the region of the contact surface of said contact element, which extends transversely to the swivel arm or lifting and tipping frame. The yielding buffering and damping device and the limited spatial mobility of the contact element provided by this device afford the advantage that even quite substantial impacts against the contact element such as are liable to occur when shunting dust-carts or when bringing objects such as dustbins against the emptying device can be buffered and absorbed without any permanent damage to the contact element or to its connection with the swivel arm or lifting and tipping frame or to the object brought into contact with it, such as a dustbin. In the course of operation of the emptying devices such as dustbin emptying devices, the buffering and damping device also provides the special advantage that sudden or jerking movements of the swivel arm or lifting and tipping frame are to a considerable extent buffered before being transmitted from the contact element to the wall of the container to be emptied. This provides advantageous protection for the wall of the container, especially in the event of a sudden swinging or tipping movement.

In one embodiment of this invention, the buffering and damping device comprises at least one elastic supporting and connecting element attached between the contact element and the swivel arm or lifting and tipping frame or a rigid carrier element provided there, this supporting and connecting element at the same time constituting the safety device protecting the contact element against impact. It is preferred to provide a plurality of such elastic supporting and connecting elements which should preferably consist of vibration damping material. The one or more than one supporting and connecting element provides a buffering and damping effect especially against impacts from the swivel arm or lifting and tipping frame, for example when the swivel arm or lifting and tipping frame runs into an end position or a rocking movement on the swivel arm or lifting and tipping frame sets in suddenly. The buffered, attenuated transmission of such impacts and the damping of the vibrations produced in the event of such impacts provide considerable protection for the container wall resting against the contact element. As an extension and further development of this embodiment of the invention, the elastic supporting and connecting elements are so formed that they can break or tear off so that they serve as predetermined locations of breakage between the swivel arm or lifting and tipping frame or a rigid carrier element provided there and the contact element. Exceptionally severe impacts are therefore liable to break one or other of the supporting and connecting elements rather than severely damage the contact element, the swivel arm or lifting and tipping frame or any object colliding with the contact element.

Particularly suitable supporting and connecting elements are in the form of rubber-metal blocks with metal plates at their end faces, one of these metal plates being attached to the swivel arm or lifting and tipping frame or to a rigid carrier element provided there while the other metal plate is rigidly attached to the back of the contact element.

If the contact element is bow-shaped, it is particularly suitable to use a safety device comprising four supporting and connecting elements arranged pairwise one above the other on both sides of the vertical mid-axis of the contact element. This crosswise arrangement of the supporting and connecting elements provides exceptional safety in absorbing shocks exerted on the bow-shaped contact element. At the same time, this connection of the bow-shaped contact element with the swivel arm or lifting and tipping frame is exceptionally yielding and shock-absorbing so that any impacts on the swivel arm or lifting and tipping frame, for example those produced when the end position of tipping is reached, can only be transmitted in a highly attenuated and buffered form to the contact element so that they cannot damage the wall of the container.

In another embodiment of this invention, the contact element is in the form of a substantially rigid bow with a yielding lining which constitutes at least part of the yielding buffering and damping device and at the same time serves as a yielding abutment for the wall of the container to be emptied, this yielding and resilient lining extending right across to and over the two lateral ends of the bow-shaped element. This yielding lining prevents the transmission of hard impacts from the swivel arm or lifting and tipping frame to the wall of a container by way of the contact element with which the container is in contact. Conversely, the yielding lining which constitutes part of the yielding buffering and damping device also prevents the transmission of hard impacts from a container which has been moved or driven hard against the contact element to the swivel arm or lifting and tipping frame. Even in the event of a backward collision of a dust-cart causing the contact element to strike against a hard object, such an impact is buffered and damped by the yielding lining which forms part of the yielding buffering and damping device. The yielding lining provided in such a rigid bow-shaped contact element is particularly effective when used in conjunction with elastic supporting and connecting elements attached in the path of force between the contact element and the swivel arm or lifting and tipping frame. Such a yielding lining should as far as possible extend at least over the two lateral ends of the contact element so that every part of the bow-shaped contact element benefits from this advantageous buffering and damping characteristic and the advantageous functional cooperation between the lining and the elastic supporting and connecting elements.

One advantageous example of a yielding lining which has an exceptionally efficient buffering and damping action consists of a flexible tube filled with liquid or gas, for example compressed air, and attached at both its ends to the lateral ends of the bow-shaped contact element and fixed by part of its circumferential wall to the contact element which another part of its circumferential wall forms the yielding abutment surface for the container to be emptied. Every region of this tube provides a soft receiving surface for the wall of the container and adapts itself to the wall of the container even if the container has not been positioned correctly in front of the parts of the emptying device designed to receive it, as frequently occurs, especially in the emptying of dustbins. The lining tube is also able to yield and thus dampen and absorb shock when an object strikes against it. These buffering and damping effects are positively superimposed in a particularly advantageous manner on the buffering and damping effects of the elastic supporting and connecting elements which are mounted in the path of force between the contact element and the swivel arm or lifting and tipping frame.

In a preferred embodiment of the invention, the contact element is a substantially rigid bow-shaped element having a yielding lining in the form of a belt extending freely between the two ends of the bow-shaped element and fixed to the ends thereof, which belt constitutes at least part of the yielding buffering and damping device and forms a yielding abutment for the wall of the container to be emptied. This belt is even better able to fit snugly against the wall of the container when the device is in operation and any hard impacts coming from the swivel arm or lifting and tipping frame will be buffered by the belt and distributed over a large surface area before being transmitted to the container to be emptied. The transmission of these impacts is attenuated to such an extent that the container wall is shielded against damage but at the same time the transmission is hard enough to enable shaking vibrations to be effectively exerted on the container to be emptied. Above all, this contact belt fits almost perfectly against the container wall when transmitting force so that forces are optimally transmitted to every part of the container wall, and even if a container has been inserted inaccurately or crookedly into the emptying device. Moreover, the contact belt will also adapt itself to any deformed regions of the container wall, even if the container wall has an irregular form. The belt also constitutes a highly effective part of the yielding buffering and damping device when any objects are moved abruptly into contact with the belt, as for example a container which is to be emptied, or if in the event of a backward collision of the dust-cart carrying the emptying device, the contact element and belt strike hard against a solid object. If buffering supporting and connecting elements are arranged in the path of force between the contact element and the swivel arm or lifting and tipping frame, a highly advantageous functional cooperation between the buffering supporting and connecting elements and the contact belt is obtained, particularly since the buffering and damping effect of the belt is superimposed upon that of the supporting and connecting elements. The ends of the belt may be in the form of loops by which the belt may be suspended on receiving pins extending substantially parallel to the longitudinal axis of the swivel arm or lifting and tipping frame at the ends of the contact element. Alternatively, the ends of the belt may be fastened by clamping plates at the ends of the contact element.

The contact belt may have an elasticity and inherent rigidity sufficient to enable it to assume a particular form when not under stress. It would then be preferable to design the belt so that it is bow-shaped in the unstressed condition and therefore ready at any moment to receive a container to be emptied. The belt may consist of a band of woven textile or it may consist of a rubberized or plastics impregnated fabric. It would also be advantageous to use a belt in the form of a strip of natural or synthetic rubber or a strip of plastics material reinforced with a textile insert. All these variations are particularly suitable for obtaining a belt having the required inherent rigidity and elasticity to enable it to assume any desired form in the unstressed state. At the same time, a contact belt formed according to these various possibilities is also sufficiently yielding to ensure that it can always fit snugly against the wall of any container to be emptied.

If the substantially rigid bow-shaped contact element is also to be provided with lateral buffering means which are to provide a buffering effect on the outside, the yielding lining of the contact element may be equipped with an elastic shock absorber at each end. If a contact belt is used as elastic lining, it may have thickened suspension loops at each end to serve as elastic shock absorbers. These lateral shock absorbers provide substantially improved protection for the contact element against any objects striking against it or in the event of the contact element striking against a fixed obstruction.

BRIEF DESCRIPTION OF THE DRAWING

Embodiments of the invention are described below by way of example with reference to the attached drawing, in which.

SPECIFIC DESCRIPTION

In the examples illustrated, the invention is applied to lifting and tipping devices 10 having a lifting and tipping frame 12 attached to a swivel arm 11 by way of a four-link guide. The devices for displacing the lifting and tipping frame 12 in relation to the swivel arm 11 and for displacing the swivel arm 11 have been omitted for the sake of clarity.

Figure 1:
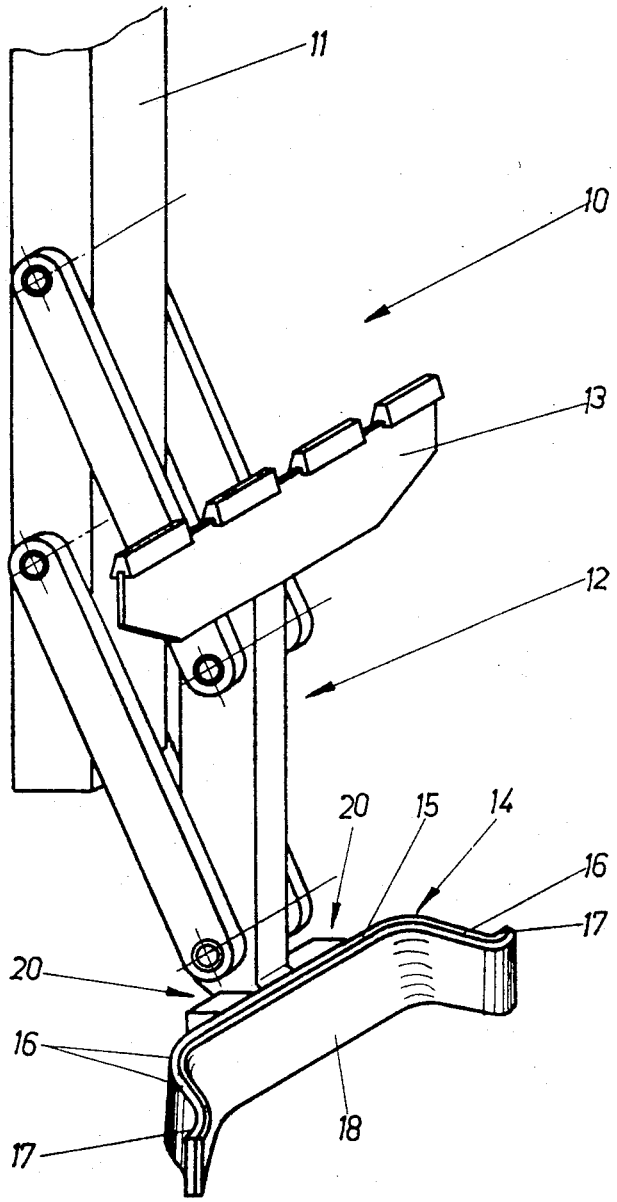
FIG. 1 represents a lifting and tipping frame for a dustbin emptying device with bow-shaped contact element for the lower part of the dustbin wall, equipped with a yielding buffering and damping device according to the invention.
Figure 2:
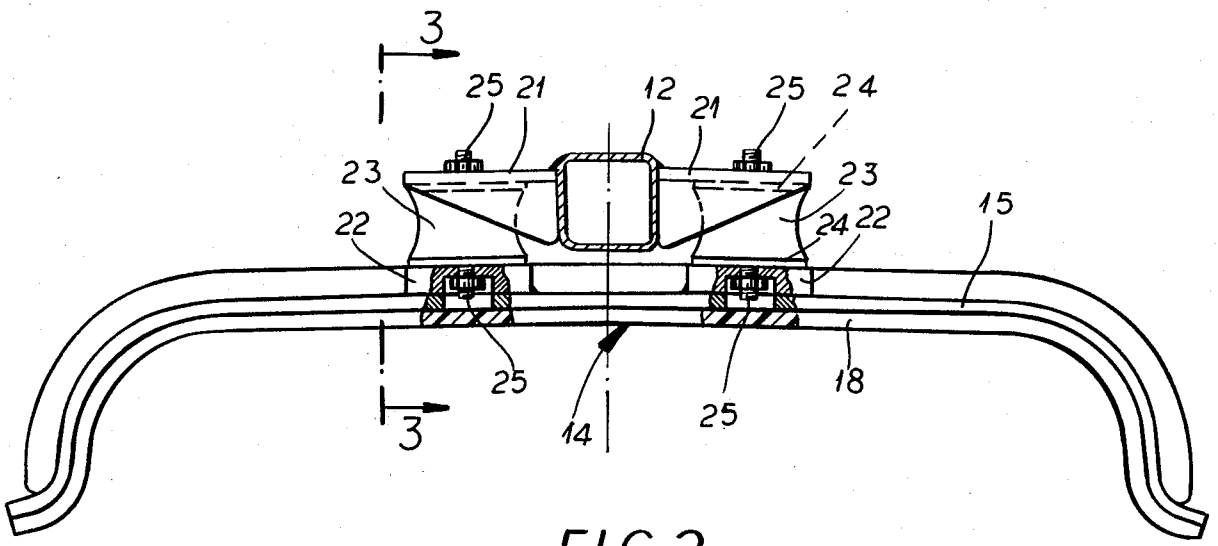
FIG. 2 is a top plan view partly in section of the bow-shaped contact element of a lifting and tipping frame of FIG. 1.
Figure 3:
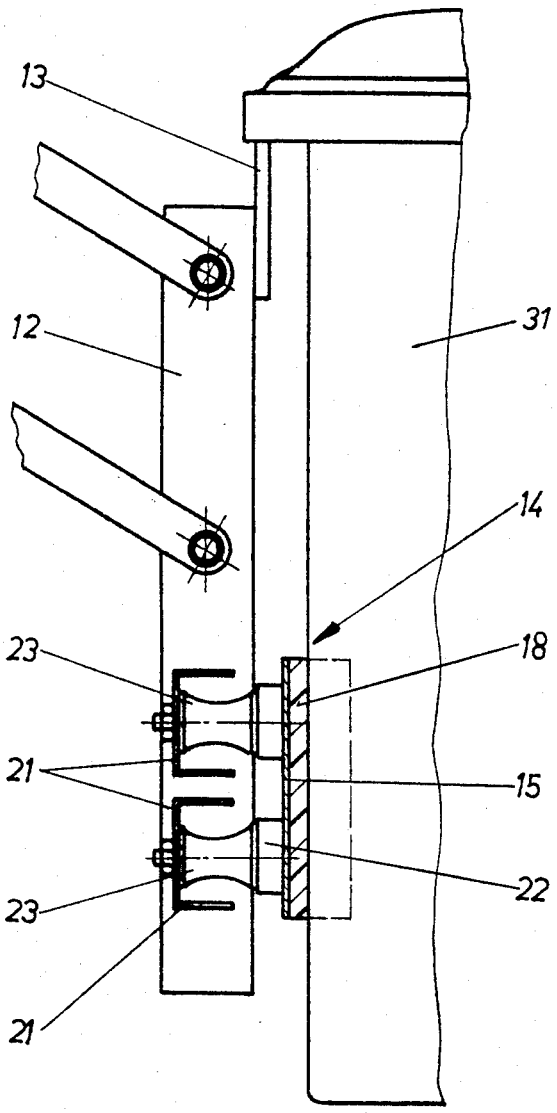
FIG. 3 is a section through 3—3 of FIG. 2 showing the lifting and tipping frame of FIG. 2 with a dustbin placed in position.

The lifting and tipping frame 12 comprises a carrier 13 designed to grip underneath the upper circumferential rim of the container to be emptied, e.g. a dustbin 31 (FIG. 3). This carrier is formed to receive, for example, dustbins of polygonal cross-section with rounded corners of the peripheral wall. The carrier element 13 is capable of receiving both large and small dustbins. Attached to the lower part of the lifting and tipping frame 12 is a bow-shaped contact element 14 wide enough to receive the larger and wider dustbin. Dustbins of large capacity are placed centrally on the carrier part 13 and received centrally by the bow-shaped contact element 14 while smaller and correspondingly narrower dustbins are placed eccentrically on the carriers 13, to one or other side thereof, and received correspondingly eccentrically by the bow-shaped contact element 14. The contact element 14 consists of a rigid, bent bar 15 of steel having a rearwardly extending arm 16 at each end. These arms 16 curve outwards at their free ends to form flanges 17. In the example of FIGS. 1 to 3, the rigid bar 15 is lined with a buffering and damping contact surface 18, for example of rubber or soft, yielding plastics material. This lining 18 may include a layer of foam. The lining 18 extends both over the internal surface of the rigid bar 15 and over the internal surface of the arm 16 and the rear surface of the flange 17.

Figure 4:
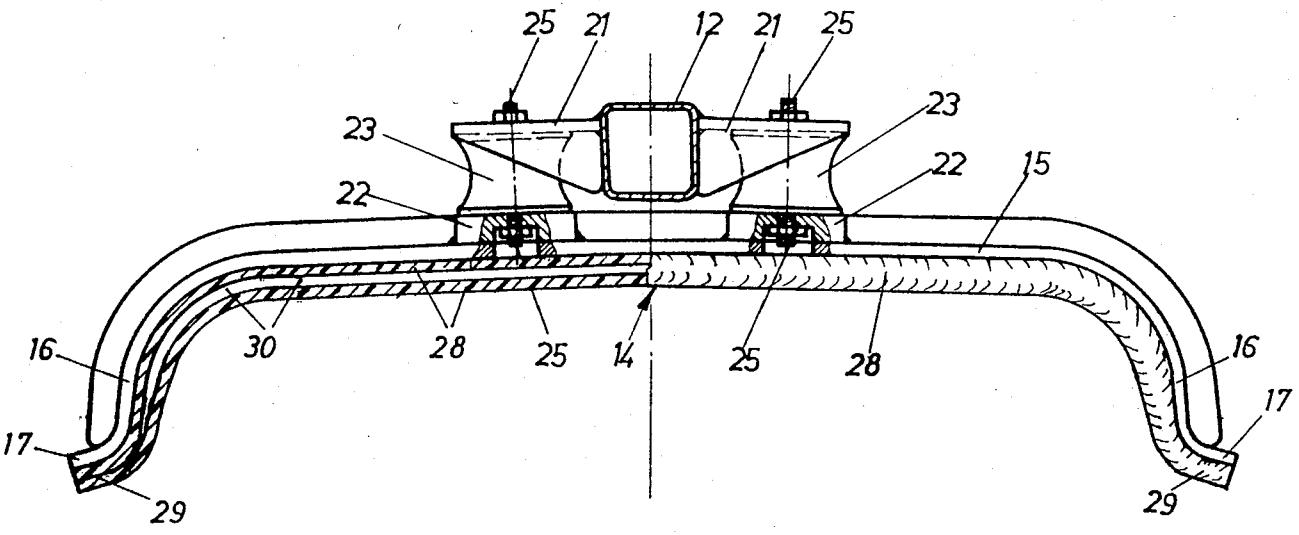
FIG. 4 is a view similar to that of FIG. 2 showing a modified form of contact element for a lifting and tipping frame of FIG. 1.

In the example of FIG. 4, a tubular, yielding lining 28 is fitted to the bar 25. This tube may consist of rubber, preferably rubber with a textile insert or plastics with a suitable reinforcing insert. Each end 29 of the tube is tightly closed, for example by being vulcanized, welded or glued. The ends of the tube 28, thus made stiff and firm, are attached to the flanges 17, as shown in FIG. 4, outside the bar 15 itself and the bar ends 16. These stiffened ends 29 therefore do not come into contact with the wall of the container during the lifting and tipping movement of the lifting and tipping frame 12. Dustbins are nevertheless liable to strike against these stiffened ends 29 when they are brought towards the lifting and tipping device 11 but the stiffening of these ends is then advantageous since it prevents damage to the yielding part of the lining 28. Even if one of the outer flange regions 17 of the bow-shaped contact element 14 strikes against some object, the stiffening provided by sealing the ends 29 effectively protects the bow-shaped contact element and the lifting and tipping device against hard impacts as well as protecting the yielding lining 28.

The interior 30 of the tube is filled with liquid, for example water containing antifreeze, or preferably with gas, for example, air under pressure. This tubular lining 28 is firmly attached on one side thereof, i.e. over part of its circumferential wall, to the rigid bar 15 while the part of the circumferential wall of the tube which is freely exposed on the internal side of the bar 15 forms the yielding abutment surface for the container which is to be emptied. The yielding lining formed by a tube filled with liquid or gas has the particular advantage that it can adapt itself very effectively to the form of the wall of the dustbin carried by the element 15 so that, in cooperation with the elastic supporting and connecting elements, it ensures optimum buffering of a dustbin on the lifting and tipping frame against the forces of impact. At the same time, this yielding, tubular lining 28 is also optimally able to adapt itself to the wall of a dustbin even when this has been set eccentrically or inaccurately in position. The yielding character of this lining 28 is particularly suitable in enabling the dustbin once it has been taken up into the device to right itself even when the lifting and tipping frame is already in motion so that it may subsequently still take up the correct position for the emptying process.

In both embodiments of FIGS. 1 to 4, the bar 15 is connected to the lifting and tipping frame 12 by way of a shock protective safety device 20. For this purpose, carrier plates 21 are rigidly fixed, for example by welding, on both sides of the lifting and tipping frame 12 in the region of the contact element 14, as may be seen more clearly in FIGS. 2 to 4. A carrier mounting 22 is welded to the back of the rigid bar 15. Supporting and connecting blocks 23 are placed between the carrier mounting 22 and the carrier plates 21. In the example illustrated, these supporting and connecting blocks 23 consist of rubber-metal elements having a metal plate 24 and screw bolt 25 at each end face. These supporting and connecting blocks 23 are mounted on the respective carrier plates by the metal plates 24 on one end face and are fixed into position there by the screw bolts 25. The metal plates 24 at the other end face connect the supporting and connecting blocks to the carrier mounting 22 and, as shown in FIG. 3, the supporting and connecting blocks are fixed to the carrier mounting 22 by the screw bolt 25 provided at that end face. As may be seen from FIGS. 2 to 4, two supporting and connecting blocks 23 arranged one above the other are provided on each side of the lifting and tipping frame 12 so that there is a total of four such blocks situated one at each corner of a rectangle. In this example, each supporting and connecting block 23 has its own carrier plate 21 welded to the lifting and tipping frame. These carrier plates 21 may be bent over laterally as shown in FIGS. 2 to 4, so that they have a substantially U-shaped profile, both to increase the stability and to provide a certain covering for the supporting and connecting blocks 23.

The supporting and connecting blocks 23 constitute the only connection between the lifting and tipping frame 12 and the rigid bar 15. Due to the resilience of the supporting and connecting blocks, the bar is capable of rocking within limits in relation to the vertical axis of the lifting and tipping frame 12 and is therefore capable of compensating for any eccentric loading resulting from the eccentric positioning of a smaller dustbin. The supporting and connecting blocks 23 provided as the only means of connection also constitute a safety device protecting the contact element 14 against knocks or impacts on the rigid bar 15. Minor knocks or impacts are absorbed and buffered by the supporting and connecting blocks 23 whereas larger impacts such as may occur, for example, when the bar 15 strikes against an object or gets caught on it when the dust-cart is in motion, cause the supporting and connecting blocks 23 to be torn off without the bar 15 and lining 18 being damaged. Torn or damaged supporting and connecting blocks 23 may readily be replaced by removing the nuts on the screw bolts 25. On the side of the carrier mounting 22, this may easily be carried out if the nuts are accessible through openings 26 in the lining 18 (right-hand part of FIG. 3) or if the nuts are firmly attached to the carrier mounting so that the supporting and connecting blocks can be turned with the metal plate 24 to unscrew the bolt 25 from the nut.

In the example illustrated in FIGS. 5 to 11, the contact element 14 consists of a rigid curved bar 25 of steel and a contact belt 38 arranged on the inside of this bar.

Figure 5:
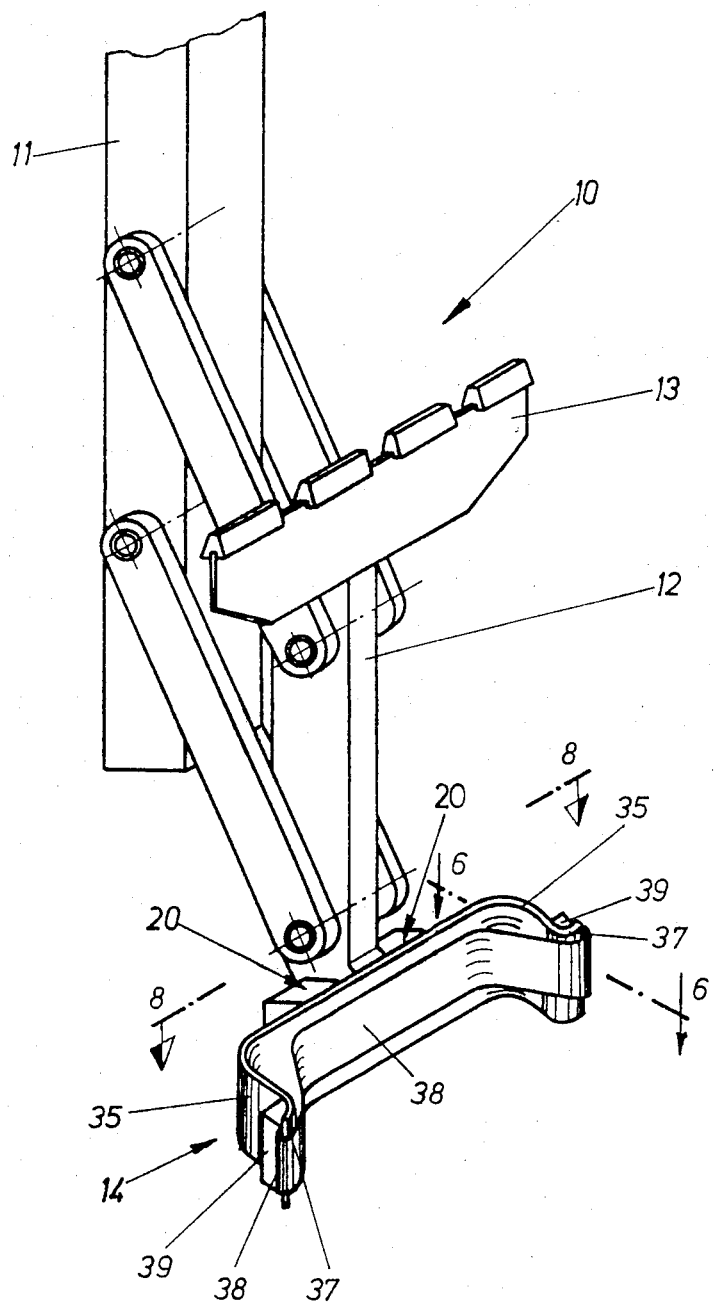
FIG. 5 is a perspective view of a second embodiment of a lifting and tipping frame for a dustbin emptying device with bow-shaped contact element for the lower part of the dustbin wall, equipped with yielding buffering and damping device.

In FIG. 5, the rigid bar 35 is bent backwards at each end to form arms 36 whose free ends are folded outwards in the form of flanges. The contact belt 38 is placed over these flange parts 37 and round the free edges and is clamped to the back of the flange part 37 and arms 36 by retaining blocks 39. The belt 38 has sufficient inherent rigidity and elasticity to assume the bow-shaped form shown in FIG. 1 when it is not under stress but it is also sufficiently yielding to fit exactly over the form of the wall of a container when under stress. In its middle region, the rigid bar 35 is connected to the lifting and tipping frame 12 by a safety or impact protective device 20.

Figure 6:
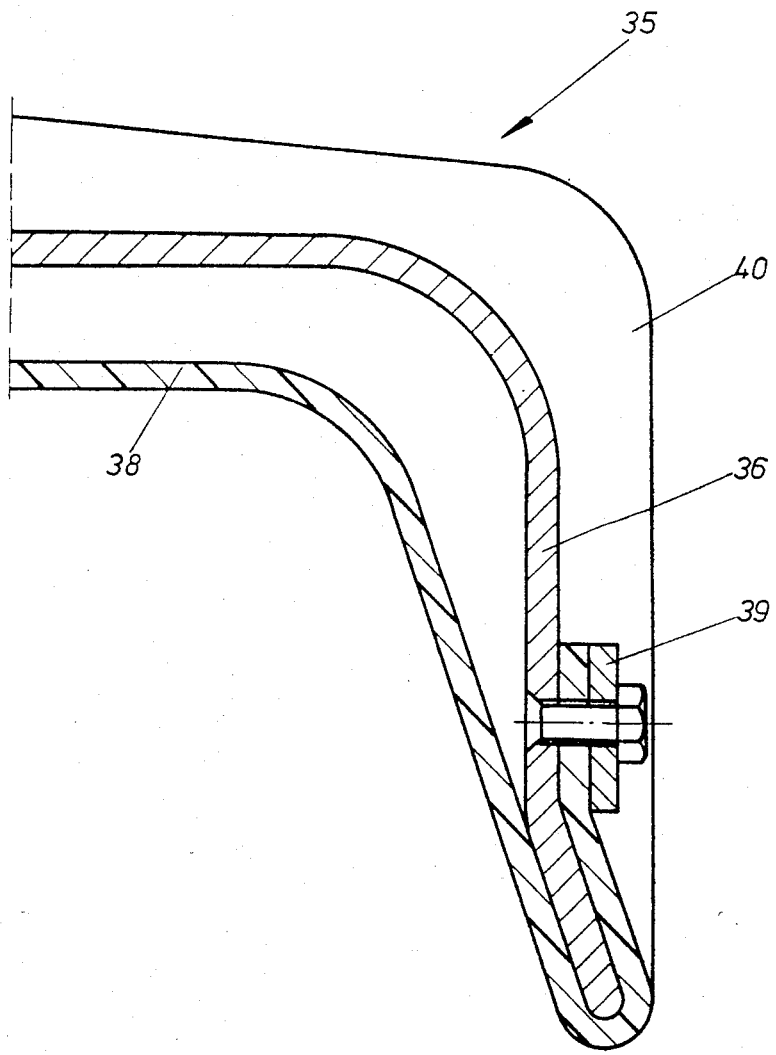
FIG. 6 is a partial sectional view taken on the line 6—6 of FIG. 5, showing a somewhat modified embodiment on an enlarged scale.

The attachment of the belt 38 to the rigid bar is shown on an enlarged scale in FIG. 6. This shows that the wall of the bar is just as thick at the free ends of the arms 36 as at the upper and lower edge of the bar 35, where the stiffening flange 40 is provided, but curved outwards at the free ends and rounded off at the free edges. The contact belt 38 in the form of a band is passed over this rounded edge to the outside wall of the bar, where it is clamped into position by a retaining block 39 in the form of a strip screwed to the arm 36 of the bar. The ends of the belt 38 may in addition be glued or vulcanised to these blocks 39.

Figure 7:
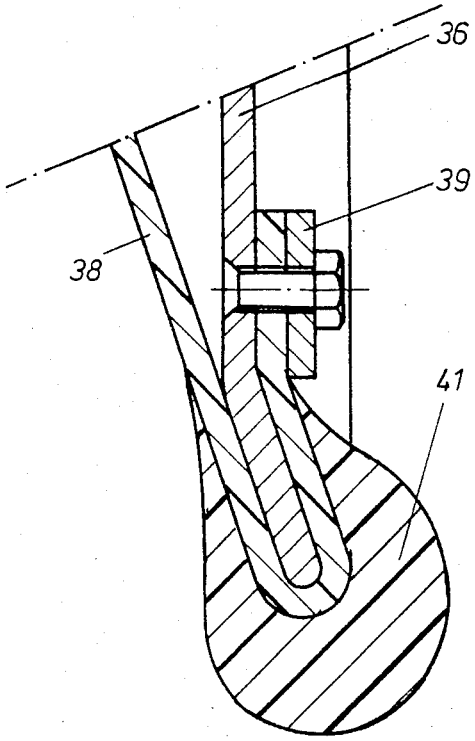
FIG. 7 is a partial view of FIG. 6 with a further modification.

As may be seen from FIG. 7, the contact belt 38 may also serve as carrier for laterally placed shock absorbers 41. For this purpose, the belt 38 has an elastic thickened portion in the region extending round the flanged end of the arm 36. This thickened portion may be made of rubber or a resilient plastics material and may, for example, be glued or vulcanized to the belt 38.

In the modified form of attachment of the belt 38 to the rigid bar 35 shown in FIGS. 8 to 11, a holding spindle 42 consisting of a pin 43 and a sleeve 44 rotatably mounted thereon is provided at the free end of each arm 36 of the bar to extend in the axial direction of the lifting and tipping frame 12. A suspension loop 45 formed at each end of the belt 38 is placed over its respective holding pin 42.

Figure 10:
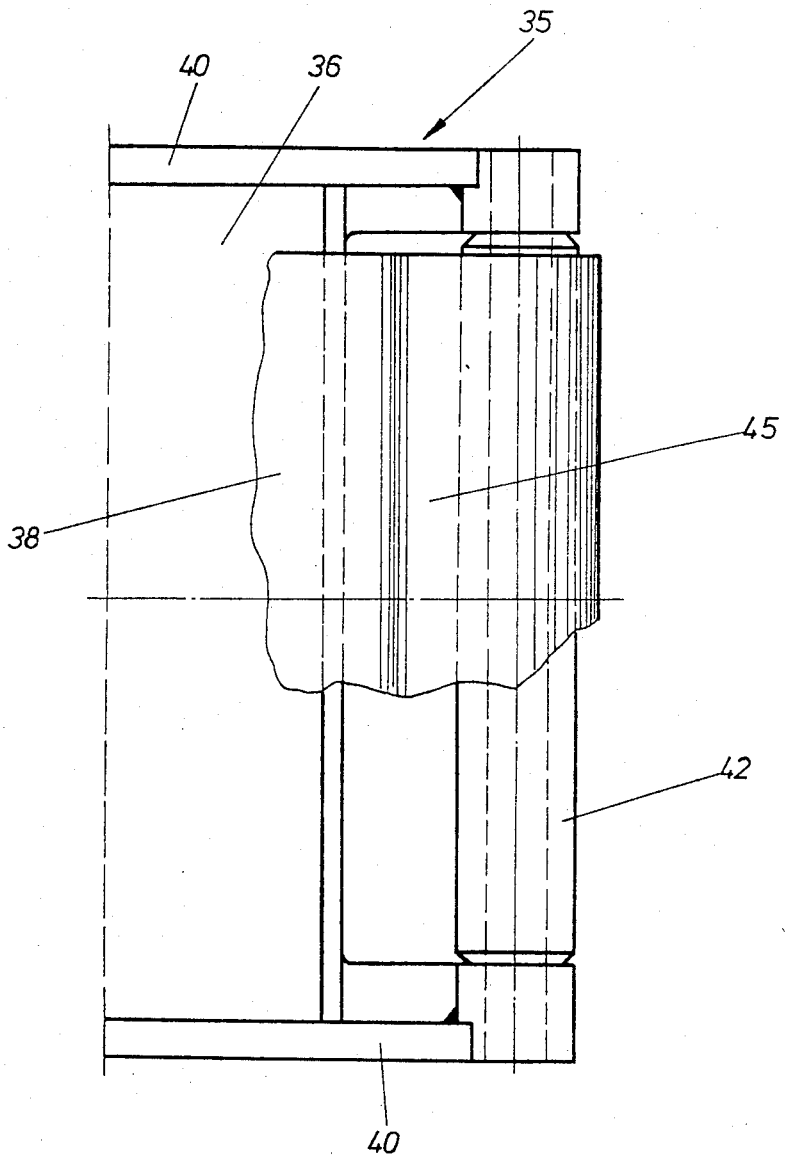
FIG. 10 is a rear view of the portion 9 of FIG. 8.

The rigid bar 35 is reinforced in this example by a stiffening flange 40 on the upper and lower side thereof. These stiffening flanges are extended beyond the outwardly bent wall of the bar at the free ends of the arms 36. The holding spindles 42 are inserted between these extended parts of the flange 40, as shown in FIG. 10. In this embodiment, the belt is easily inserted in the rigid bar 35 and can also easily be replaced by removing the sleeves 44, which are glued or vulcanized into the loops 45, from the pins 43 of the spindle.

Figure 11:
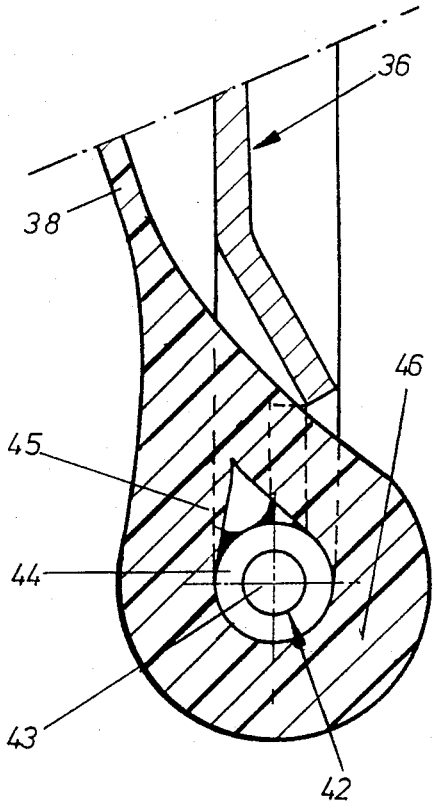
FIG. 11 shows a portion of FIG. 9 with a modified end of the contact belt.
Figure 8:
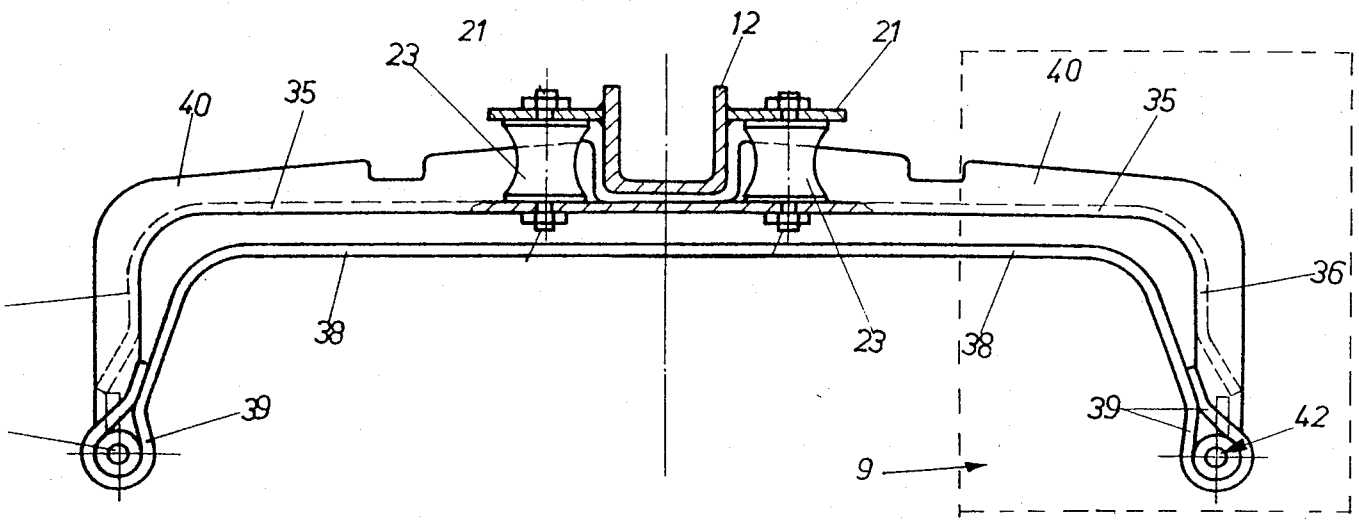
FIG. 8 is a top plan view taken on the line 8—8 of FIG. 5 showing a further variation of the bow-shaped contact element.
Figure 9:
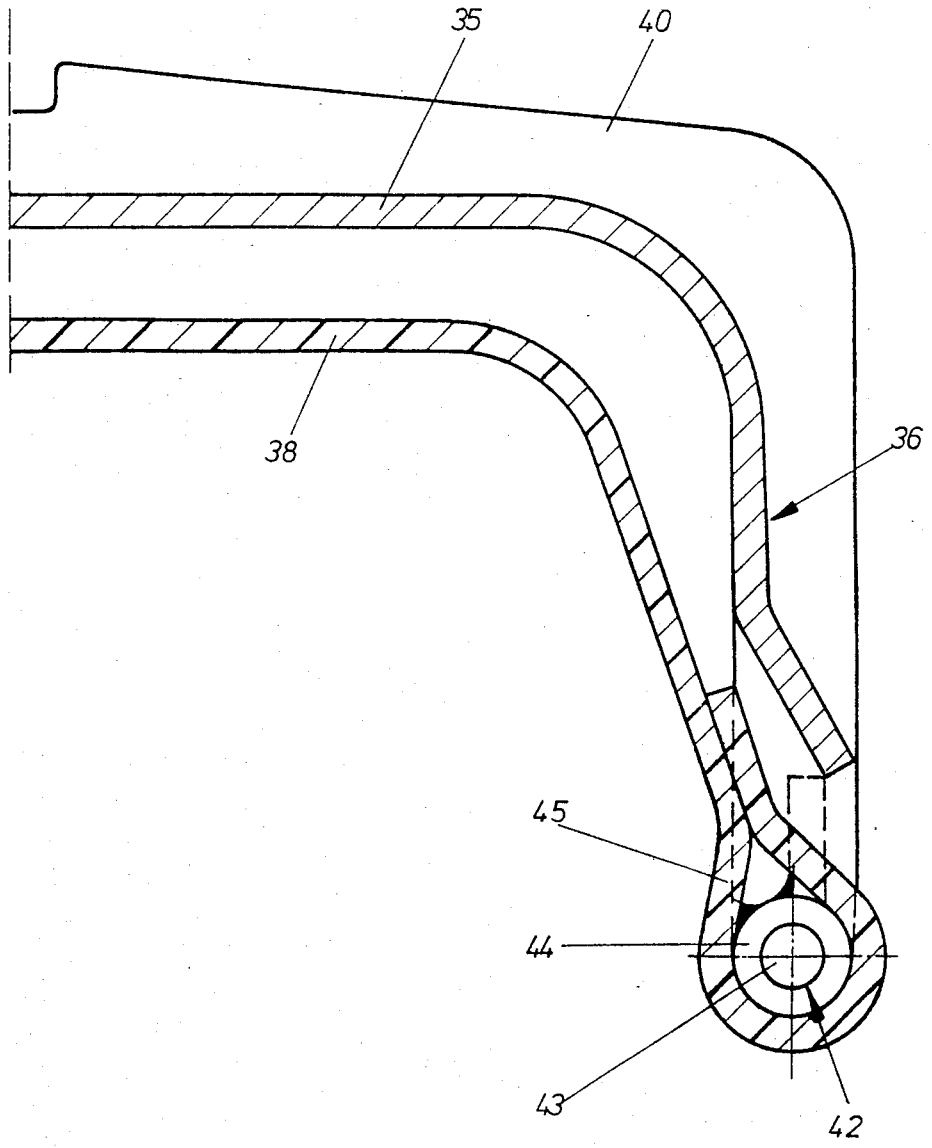
FIG. 9 is a sectional view through the portion 9 of FIG. 8 on an enlarged scale.

In the example illustrated in FIG. 11, the suspension loops 45 are considerably thickened and symmetrical in form. Each loop 45 is made to form an integral part of one or other end of the belt 38, in particular by being vulcanized thereto, and forms a shock absorber 46 projecting right round the end of the flange 40. Due to the symmetric form of this shock absorber 46 and loop 45, the whole belt 38 can be turned round inside the bar 35 if it is partly worn down; in other words, it may be removed from the bar and reinstalled in the reverse position.

The contact belt 38 provided in the examples of FIGS. 5 to 11 may be rubberized or impregnated with plastics material for the purpose of increasing its inherent rigidity and elasticity so that it assumes its trapezoidal or bow-shaped form when not under stress. The belt 38 may, however, also be made of some other material, for example a strip of natural or synthetic rubber reinforced with a textile insert or steel gauze insert. Suitably reinforced plastics strips may also be used to form the belt 38.

In the examples of FIGS. 5 to 11, the impact protective safety device 20 used for attaching the rigid bar 15 to the lifting and tipping frame 12 consists of four supporting and connecting blocks 23 in the form of rubber-metal elements having metallic end plates and rubber bodies in the middle. These rubber-metal blocks 23 resemble those used in the example of FIGS. 1 to 4 in being screwed to the external surface of the wall of the bar 35 by one of its end plates. The second end plate is screwed to a plate forming a carrier element 21 which is rigidly attached to the lifting and tipping frame 12, for example by welding. In this arrangement, two supporting and connecting blocks 23 are arranged one above the other on each side of the lifting and tipping frame 12 so that there is a total of four such blocks 23 arranged at the corners of a rectangle.

I claim:

1. In a device for emptying dustbins in a dust car wherein a lifting and tilting frame is provided at a lower end portion of a swivel arm of a tipping device, said lifting and tilting frame being provided with a dustbin lifting member at an upper portion thereof and a contact element at a lower portion thereof engageable with the body of the dustbin, the improvement wherein in combination:

said contact element is a bow-shaped bar having outwardly bent ends and forming a main load-bearing means upon tilting of the dustbin;

said bow-shaped element is provided with at least one yieldable buffer and dumping device extending along the length of said bar at least between said ends for engaging a container to be emptied, upon the lifting of said container by said member;

an impact protective safety device is provided between said bar and said frame and enables resilient displacement of said bar with respect to said frame in substantially all directions; and said impact protective safety device is the sole connection and coupling provided between said bar and said frames and is directly disposed in force transmitting relationship between them.

2. The improvement defined in claim 1 wherein the buffer and damping device comprises a plurality of elastic supporting and connecting elements attached between the contact element and the lifting and tipping frame, which supporting and connecting elements at the same time form the impact protective safety device of the contact element.

3. The improvement defined in claim 2 wherein each elastic supporting and connecting element is designed to tear off and is inserted at a predetermined locations of tearing into the connection between the lifting and tipping frame and the contact element.

4. The improvement defined in claim 1 wherein the supporting and connecting elements are symmetrically arranged on both sides of a vertical central support of the lifting and tipping frame.

5. The improvement defined in claim 1 wherein the supporting and connecting elements are rubber-metal blocks having metal plates at their end faces, one metal plate thereof being rigidly attached to the lifting and tipping frame and a second metal plate rigidly attached to the back of the contact element.

6. The improvement defined in claim 5 wherein four supporting and connecting elements are arranged pairwise one above the other on both sides of the vertical mid-axis of the bow-shaped contact element.

7. The improvement defined in claim 1 wherein the contact element is in the form of a substantially rigid bar having a yielding lining which constitutes at least part of the yielding buffer and damping device and at the same time forms a yielding counter-abutment for the peripheral wall of the container to be emptied, this yielding lining extending over the two lateral ends of the bar.

8. The improvement defined in claim 7 wherein the yielding lining is formed by a flexible tube which is closed at its two ends situated at the lateral ends of the bar and is filled with a fluid, which lining tube is attached by part of its circumferential wall to the bar while another part of its wall forms the yielding counter-abutment surface for the container to be emptied.

9. The improvement defined in claim 8 wherein the ends of the belt are held between the ends of the bar and clamping blocks.

10. The improvement defined in claim 7 wherein the yielding lining carries an elastic shock absorber at each end.

11. The improvement defined in claim 10 wherein a contact belt forming the elastic lining has thickened suspension loops at its two ends to form the elastic shock absorbers.

12. The improvement defined in claim 1 wherein the contact element is in the form of a substantially rigid bar having a yielding lining in the form of a contact belt which is fixed to the ends of the bar and extends freely between these two ends, which belt constitutes at least part of the yielding buffer and damping device as well as forming a yielding counter-abutment for the peripheral wall of the container to be emptied.

13. The improvement defined in claim 12 wherein the ends of the contact belt form suspension loops which are placed over holding pins provided at the ends of the bar and extending substantially parallel to the longitudinal axis of the lifting and tipping frame.

14. The improvement defined in claim 12 wherein the belt has sufficient inherent rigidity and elasticity to assume a predetermined form when in the unstressed state.

15. The improvement defined in claim 14 wherein the contact belt is designed to assume a bow-shaped form in the unstressed state.

16. The improvement defined in claim 12 wherein the contact belt is a textile fabric band.

17. The improvement defined in claim 12 wherein the contact belt is made from rubberized or plastic-impregnated fabric.

18. The improvement defined in claim 12 wherein the contact belt is formed from a rubber strip of natural or synthetic rubber or plastic strip reinforced with a textile insert or steel gauze insert.

19. In a device for emptying dustbins to a dust car wherein a lifting and tilting frame is attached to the lower region of the swivel arm of a tipping device, said lifting and tilting frame being provided with a dustbin lifting member at an upper portion thereof and a contact element at a lower portion thereof engageable with the body of the dustbin, the improvement wherein in combination:

said contact element is a bow-shaped bar having outward ends;

said bow-shaped bar is provided with at least one yieldable buffer and dumping device extending along the length of said bar at least between said ends for engaging a container to be emptied, upon the lifting of said container by said member; and an impact protective safety device is provided at said outward ends of said bow-shaped bar and is formed by elastic shock absorber elements made of rubber or a resilient plastics material, each one of said elastic shock absorber elements being mounted to each one of said outward ends of said bow-shaped bar.

20. The improvement defined in claim 19, wherein the contact element is in the form of a substantially rigid bar having a yielding lining in the form of a contact belt which is fixed to the ends of the bar and extends freely between these two ends, which belt constitutes at least part of the yielding buffer and dumping device as well as forming a yielding conter-abutment for the peripheral wall of the container to be emptied, said contact belt carrying said elastic shock absorber element at its end portions.

21. The improvement defined in claim 20, wherein the ends of the contact belt form suspension loops which are placed over holding pins provided at the ends of the bar and extending substantially parallel to the longitudinal axis of the lifting and tipping frame, said suspension loops of the contact belt being thickened to form the said elastic shock absorber element.

22. In the improvement defined in claim 20, wherein the said contact belt has elastic thickened end portions each one of said end portions being extending around each one of the said outward ends of the bow-shaped bar and being held between the respective end of the bar and a clamping block.

23. The improvement defined in claim 19, wherein the contact belt has sufficient inherent rigidity and elasticity to assume a predetermined form when in the unstressed state.

24. The improvement defined in claim 19, wherein the contact belt is a textile fabric band, the said shock absorber elements being glued or vulcanized to the said contact belt.

25. The improvement defined in claim 19, wherein the contact belt is made from rubberized or plastic-impregnated fabric and said shock absorbing elements are glued or vulcanized to the said contact belt.

26. The improvement defined in claim 19, wherein the contact belt is formed from a rubber strip of natural or synthetic rubber or plastic strip reinforced with a textile insert or steel gauze insert and said shock absorbing elements are glued or vulcanized to the said contact belt.

* * * * *